United States Patent [19]

Farrar

[11] Patent Number: 4,683,671

[45] Date of Patent: Aug. 4, 1987

[54] RECOIL SHOCK PAD

[76] Inventor: Frank W. Farrar, 11941 Paseo Bonita, Los Alamitos, Calif. 90720

[21] Appl. No.: 779,999

[22] Filed: Sep. 25, 1985

[51] Int. Cl.[4] ..... F41C 23/00
[52] U.S. Cl. ..... 42/74
[58] Field of Search ..... 42/1 V, 73, 74

[56] References Cited

U.S. PATENT DOCUMENTS 3,208,180 9/1965 Woodcock ..... 42/74
3,696,544 10/1972 Webb ..... 42/74

FOREIGN PATENT DOCUMENTS 147439 8/1949 Australia ..... 42/74

*Primary Examiner*—Deborah L. Kyle
*Assistant Examiner*—Ted L. Parr
*Attorney, Agent, or Firm*—Beehler, Pavitt, Siegemund, Jagger, Martella & Dawes

[57] ABSTRACT

A recoil shock absorbing cushion for attachment to a gun stock makes use of a jacket of yieldable material having a chamber in which is lodged a shock absorbing filler. The chamber has an opening which faces the gun stock. A plate covers the opening and has its side edges bonded to complementary edges of the opening. Screws are employed to fasten the pad to the end of the gun stock.

1 Claim, 11 Drawing Figures

Fig. 2.
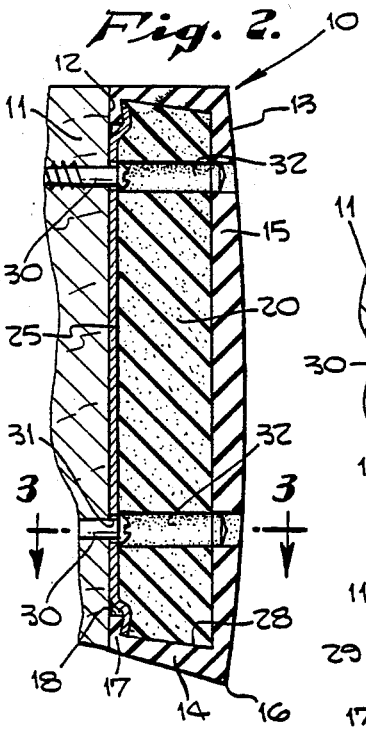
Fig. 1.
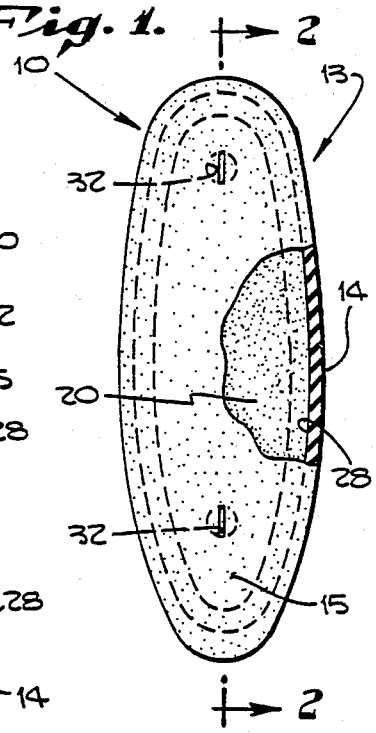
Fig. 3.
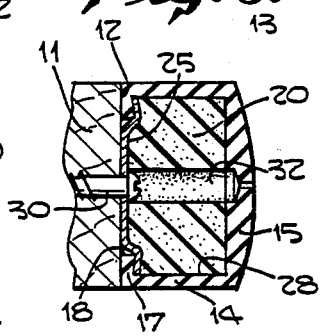
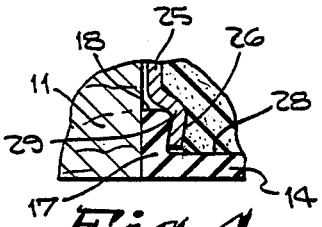
Fig. 4.
Fig. 5.
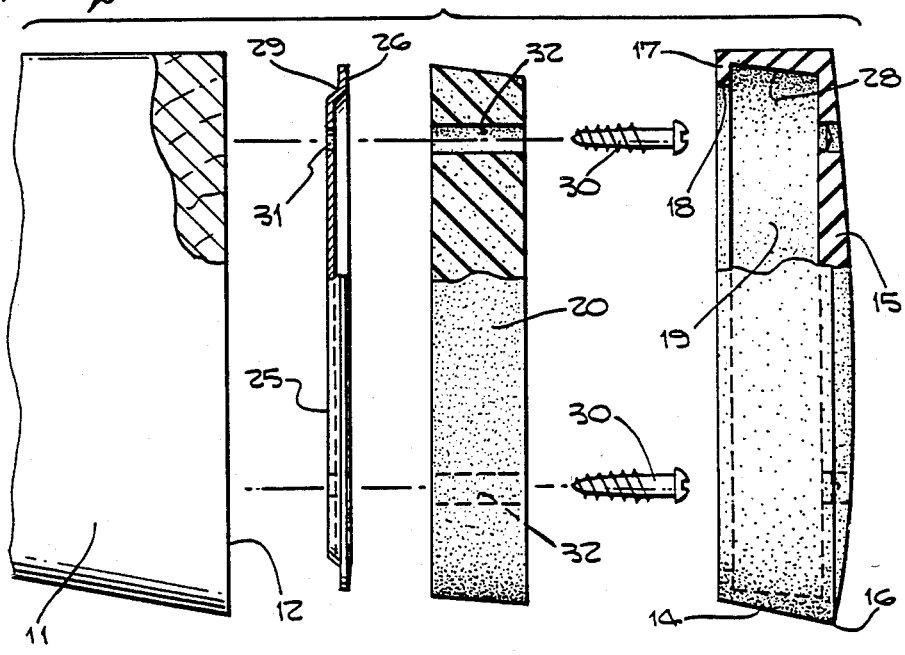

RECOIL SHOCK PAD

Need for shock absorbing cushions for a gun stock has long been recognized and has prompted a great variety of solutions. Like many other accessories for personal equipment, gun stocks for rifles and shotguns being only an example, personal needs and personal tastes may vary appreciably from one individual to another. In the case of a highly prized rifle or shotgun, the possessor takes considerable pride and exercises considerable care in the selection and maintenance of equipment.

Recoil pads heretofore available have supplied many needs but, nevertheless, have shortcomings. Some are of a character needing considerable handwork in order to fit them to the butt end of a selected gun stock in a manner preserving a neat and well-kept appearance. When the installation of such equipment is handled by individuals rather than craftsmen, accessories which require appreciable cutting, fitting and finishing have drawbacks. Since gun fanciers and owners may be prone to change accessories from time to time, extra work in fitting the new accessory in place tends to become burdensome.

It is therefore among the objects of the invention to provide a new and improved recoil shock absorbing cushion for attachment to the end surface of a gun stock which is relatively simple in construction and readily installable in place on the gun stock by persons other than skilled craftsmen.

Another object of the invention is to provide a new and improved recoil shock absorbing cushion for a gun stock which is of character such that the shock absorbing character is not only effective but also one which can be varied to suit individual preferences without need for making any substantial variance or change in the item of equipment.

Still another object of the invention is to provide a new and improved recoil shock absorbing cushion for a gun stock which is not only relatively easy to apply to the weapon, but also one which can be as readily removed for replacement with a cushion or filler of modified characteristics should the owner wish a change.

Also included among the objects of the invention is to provide a new and improved recoil shock absorbing cushion for a gun stock which has a relatively limited number of parts and which is of a construction enabling it to be manufactured at a reasonable cost.

Further still among the objects of the invention is to provide a new and improved recoil shock absorbing cushion for a gun stock which combines in one structural unit not only the capability of satisfying the need for a cushion capable of being selected to meet a variety of different needs, but at the same time one which has an inherently neat and finished appearance, capable of ready application to a selected stock and there fitted and finished to present a professional and acceptable appearance.

With these and other objects in view, the invention consists of the construction, arrangements and combination of the various parts of the device serving as examples of embodiments of the invention, whereby the objects contemplated are attained, as hereinafter disclosed in the specification and drawings and pointed out in the appended claims.

In the drawings:

FIG. 1 is an end elevational view of the cushion.

FIG. 2 is a sectional view of the cushion in place on a gun stock.

FIG. 3 is a cross-sectional view on the line 3—3 of FIG. 2.

FIG. 4 is a fragmentary cross-sectional view of a portion of FIG. 3.

FIG. 5 is an exploded view of the parts of the cushion.

Figure 6:
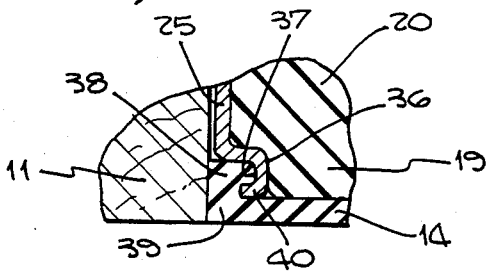
FIG. 6 is a fragmentary cross-sectional view of a modified form of the cushion.
Figure 8:
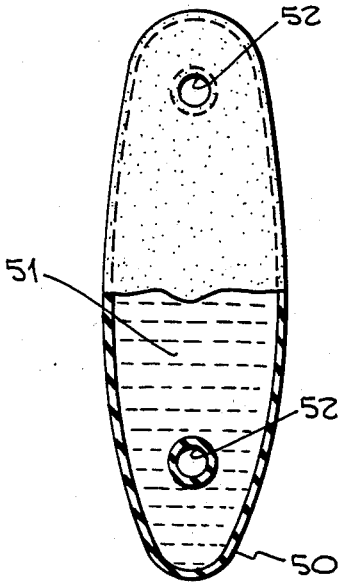
FIG. 8 is an end elevational view partially broken away of the gel filled bag of FIG. 7.

In an embodiment of the invention chosen for the purpose of illustration, an assembled shock absorbing cushion 10 is shown attached to a stock 11 of a conventional gun such, for example, as a shot gun or rifle. The stock is provided with an end face 12 for reception of the shock absorbing cushion.

Among the parts comprising the makeup of the cushion 10, is a jacket 13 of yieldable elastomeric material consisting of a perimetrical side wall 14 closed at one end with an end wall 15 which is joined to the side wall 14 along a perimetrical circumference 16. At the opposite end of the side wall 14 is a perimetrical rim 17, an inside face 18 of which defines an opening for a pocket 19. In one form of the invention, the pocket 19 is filled with a mass 20 of commercial sponge material of appropriate character, synthetic rubber sponge being an example. The spongy mass, in any event, needs to be one which remains flexible and spongy during use.

In order to close the pocket 19 and confine the mass 20, there is provided a plate 25, preferably of metal, which has a bent perimetrical portion 26, conforming approximately in shape and size to the end face 12 of the stock 11. The plate 25 is slightly smaller than the end face 12 so that it fits within an inside surface 28 of the side wall 14 of the jacket 13. Around the perimeter of the plate 25, the bent perimetrical portion provides a relatively shallow recess 29 for reception of the rim 17 of the jacket. The structure described assures a positive mechanical interlock after installation. It should be noted that the bent petrimetrical portion 26 is oblique to a degree so as to accommodate a relatively thicker inner end of the perimetrical rim 17, making certain of the interlock when the parts are in assembled condition. When ultimately assembled, the interlock just described will comprise a bonded connection between the plate 25 and the rim 17 of the jacket.

It is of consequence to note also that the outermost edge of the bent perimetrical portion 26, being of metal, forms a rigid backing for a corresponding portion of the side wall 14 which contributes to the readiness of the jacket to sizing, as by sanding, to make a smooth junction with the outside surface of the stock 11 after the shock absorbing cushion has been attached.

For attachment of the cushion 10 to the stock 11, screws 30 are made use of which extend through screw holes 31 in the plate 25. To provide access to the heads of the screws, there are screw clearance holes 32 extending through the mass 20. It will be apparent from arrangement of the parts that the plate 25 is initially attached to the stock 11. After loose attachment of the plate to the stock, the rim 17 is stretched over the perimetrical portion 26 of the plate and lodged in the shallow recess 29 where by tightening the screws it is bonded by preapplication of adhesive and clamped to the stock. In the alternative, the structure of FIGS. 1, 2, 3, 4, and 11 may be prebonded and installed as a single unit by making provision to access to the screws 30.

Figure 11:
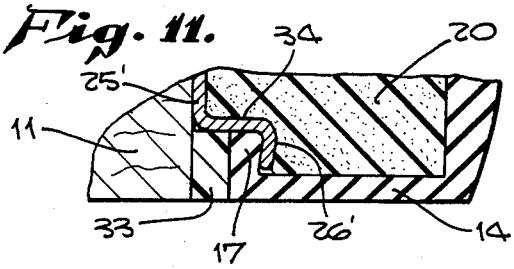
FIG. 11 is a fragmentary sectional view of a cushion similar to FIG. 2 but with a plate having a modified form at the perimeter.

In the form of the invention of FIG. 11, there has been provided a spacer 33, preferably of a synthetic plastic resin material, which follows the perimetrical outline of the rim 17 and is of comparable breadth. For this variation a plate 25' is provided with a leg 34 of length sufficient to span both the spacer 33 and the thickness of the rim 17. The bent perimetrical portion 26' overlies the rim 17 where it is bonded in the manner previously made reference to.

In cases where a firmer lateral support may be desired for the rim of a side wall 14', as shown in FIG. 6, the plate 25 may be provided with a reversely bent perimetrical portion 36. The reversely bent configuration provides in effect an end opening perimetrical pocket 37 for reception of a protuberance 38 of a modified perimetrical rim 39.

With a structure such as that hereinabove described, after the rim 39 has been stretched over the portion 36 and the protuberance 38 lodged in the pocket 37, there is additional backing and support for the side wall 14' provided by a bead 40. Here also there maybe a bond in the form of an adhesive acting between the reversely bent perimetrical portion 36 and those areas of it which engage corresponding areas of the perimetrical rim 39. The characters of the mechanical interlock of FIG. 6 may preclude the need for a bonding adhesive. This variation is one most readily adaptable to interchangeable filler material.

Figure 7:
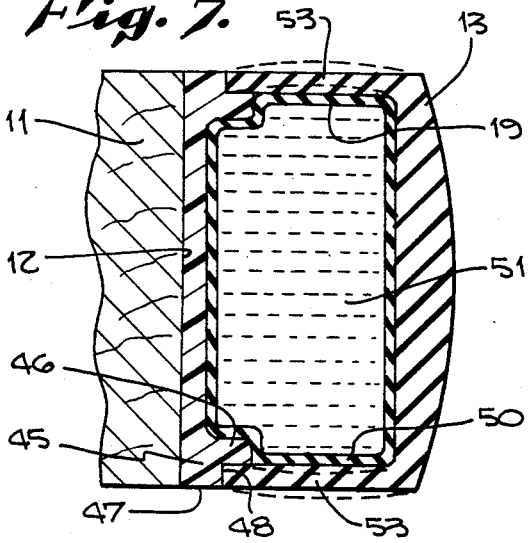
FIG. 7 is a cross-sectional view of another modified form of the cushion.
Figure 10:
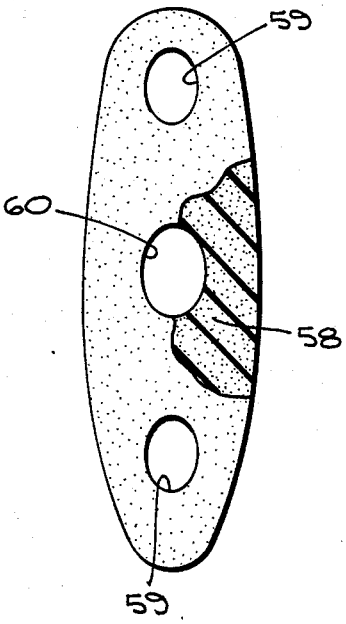
FIG. 10 is an end elevational view of the recoil absorbing mass of FIG. 9.

In still another form of the device, as in FIG. 7 there is provided a plate 45 of molded material, such as a moldable synthetic plastic resin, by way of example, which, in molding, is provided with a perimetrically extending endwardly directed flange 46, spaced inwardly from its edgemost surface 47, whereby to provide a perimetrically extending recess 48. The plate 45 is provided with screw holes 52 for accommodation of the screws (not shown). On this occasion instead of the mass 20 of sponge material heretofore made reference to, there has been provided a bag 50 adapted to be filled with a fluid material 51 which may, for example, be an appropriate commercially available gel. The bag 50 is flexible and made appropriately air-tight for retention of the fluid. The bag, moreover, may, if desired, be provided with screw clearance holes 52 for use under circumstances where the bag is to be fitted into position on the plate 45 prior to application of a jacket having a straight side wall 53. On this occasion the edge of the side wall is adapted to fit snugly within the recess 48 wherein the interfacing surfaces are appropriately bonded. Here also the presence of the flange 46 provides a firm effective backing for the side wall 53 which, as heretofore described, is of relatively flexible, yieldable material.

Although the gel 51 may be, as are most fluids, incompressible under impact, when there is the anticipated impact causing the plate 45 to exert pressure on the fluid filled bag 50, the fluid and the bag is adapted to expand both laterally outwardly against the yieldable side wall 53 and laterally inwardly into the space within the screw clearance holes 52, thereby to provide the desired cushion effect.

Figure 9:
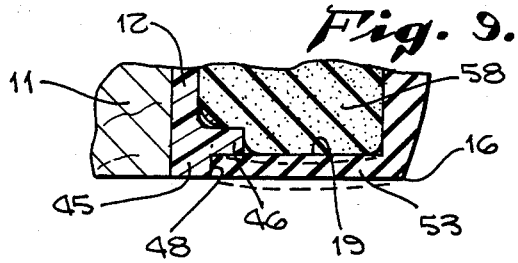
FIG. 9 is a fragmentary cross-sectional view of still another modified form of the cushion.

A comparable cushioning effect is achievable in the form of invention of FIG. 9 in which there is provided a yieldable solid mass 58 as an alternative for the fluid filled bag 50. On this occasion the mass could be, for example, commercially available "SORBOTHANE". In that the solid mass 58 is cohesive, it may have a form and size appropriately filling the pocket 19 as does the mass 20. Since the solid mass 58 is non-compactible under pressure exerted by recoil action of the gun stock 11, the mass 58 is adapted to expand both laterally outwardly against the flexible wall of the jacket or laterally inwardly into enlarged screw clearance holes 59 and also into an enlarged central space 60. By providing the holes 59 and the space 60 of relatively large circumference, there is an abundance of area surrounding the spaces into which corresponding portions of the solid mass 58 can inject itself when subjected to the recoil impact.

On those occasions where the owner of the firearm may wish to remove one cushion, either for repair or for replacement with another comparable cushion having different cushioning characteristics, where bonding has been employed, the jacket 13 is first removed by breaking the bond between the jacket and the plate and then the side wall of the jacket pried loose so that the jacket can be entirely removed.

For a structure like that of FIG. 6, where bonding has been dispensed with the entire cushion, it can readily be removed by removal of the screws.

For a structure like that of FIG. 7, the plate 45 is preferably bonded permanently to the end surface 12. Where no bonding is used between the plate and the stock removal of the screws 30 is sufficient to implement disengagement of the plate, access to the screws being had either through the screw clearance holes 32 or 52, as the case may be. A new plate of selected structure can be attached by use of the same screws and screw holes, after which the jacket and its cushioning mass is reapplied to the appropriate plate.

For the structure of FIG. 6 where no adhesive has been employed, the filler material can readily be changed. Both, the plate and the jacket would then be revisable.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. In combination with a gun stock having a lateral side surface and an end surface, a recoil shock absorbing cushion for attachment to the end surface only of a gun stock, said cushion comprising a jacket of flexible material having an interior pocket, a shock absorbing mass in said pocket, a perimetrical side wall surrounding said pocket, an end wall closing an outside end of said pocket, said side wall having a perimetrical rim extending around the inside end defining an opening for the pocket, a rigid plate having a perimetrical portion conforming in shape and size to the end surface of the gun stock and to the perimetrical rim, bonding means between the perimetrical portion of the plate and the perimetrical rim of the side wall, and means for anchoring the plate and accompanying jacket to the end surface only of the gun stock, said perimetrical rim comprising a laterally inwardly extending flange, said flange having one side facing the gun stock and another side, the perimetrical portion of the plate overlying said other side of said flange, said perimetrical rim of the side wall having a laterally inwardly and endwardly outwardly tilted flange forming a perimetrical recess within said side wall, said perimetrical portion of the plate having a reversely extending form receptive in said perimetrical recess and wherein during initial engagement of the perimetrical portion of the plate with said flange the remainder of the plate is at a location spaced endwardly outward from said one side of said flange and clear of the end surface of said gun stock.

* * * * *